US006267567B1

(12) United States Patent
Hsieh

(10) Patent No.: US 6,267,567 B1
(45) Date of Patent: Jul. 31, 2001

(54) COOLING FAN

(76) Inventor: Hsin-Mao Hsieh, No. 6, East Section, Chiao Nan Li, Industrial 6th Rd., Pingtung (TW)

( * ) Notice: Subject to any disclaimer, the term of this patent is extended or adjusted under 35 U.S.C. 154(b) by 0 days.

(21) Appl. No.: 09/542,871

(22) Filed: Apr. 4, 2000

(51) Int. Cl.[7] ..... F04B 17/00
(52) U.S. Cl. ..... 417/354; 417/423.12
(58) Field of Search ..... 417/353, 354, 417/423.12, 423.13, 424.1

(56) References Cited

U.S. PATENT DOCUMENTS 2,768,583 * 10/1956 Richard et al. ..... 417/354
3,961,864 * 6/1976 Papst ..... 417/354
5,979,541 * 11/1999 Saito ..... 417/354
6,183,221 * 2/2001 Hsieh ..... 417/423.12

* cited by examiner

*Primary Examiner*—Michael Koczo
(74) *Attorney, Agent, or Firm*—Fei-Fei Chao; Venable

(57) ABSTRACT

A cooling fan has a housing having a recess defined therein and a seat formed on a bottom face thereof. A circuit board is secured on the seat of the housing. A coil has an opening defined therethrough and a bracket is provided beneath the coil to fix it on the circuit board. A sleeve, of which a first end is enclosed, is received in the opening of the coil and has a fastener formed at a second end thereof and engaged with the outer periphery of the coil. A collar is provided at a bottom face of the sleeve. A self-lubricating bearing is provided in the sleeve and on the collar. A rotor having a core is received in the bearing and inserted through the collar.

3 Claims, 2 Drawing Sheets

COOLING FAN

BACKGROUND OF THE INVENTION

1. Field of the Invention

The present invention is related to a cooling fan, and more particular to a cooling fan which is easy to assemble, has low-noise and has an effective lubricant seal.

2. Description of Related Art

A conventional cooling fan used for a computer is shown in FIG. 3. The fan comprises a housing (80) with a recess (not numbered). A seat (801) is formed at a bottom face of the recess of the housing (80). A circuit board (83) and a stator assembly (82) are fixedly provided on an outer periphery of a sleeve (81) secured on the seat (801). A self-lubricating bearing (88) is received in the sleeve (81), and a core (841) of a rotor (84) covering the stator assembly (82) is inserted in the bearing (88). A collar (87) is provided on a distal end of the core (841) to secure the rotor (84) in the bearing (88). Washers (85) and oil-seals (86) are respectively mounted on the core (841) at both ends of the bearing (88) to prevent lubrication leaking from the bearing (88). Finally, a sheet (89) is fitted on a bottom end of the sleeve (81) to seal the workings of the fan.

However, the conventional cooling fan has some shortcomings which are as follow:

1. When the fan is running, the washers (85) and the oil-seals (86) rotate with the core (841) of the rotor (84), and friction generated between the washers (85) and the sleeve (81), and the oil-seals (86) and the bearing (88) causes a large noise.
2. Because the washers (85) and the oil-seals (86) are small elements, it is difficult to assemble them. Moreover, a special tool is needed to assemble the collar (87) on the core (841).
3. The oil-seals (86) can not completely prevent the lubrication from leaking out.

Therefore, it is an objective of the invention to provide an improved cooling fan to mitigate and/or obviate the aforementioned problems.

SUMMARY OF THE INVENTION

The main objective of the present invention is to provide a cooling fan which is easy to assemble, has a low noise and an effective lubricant seal.

Other objects, advantages and novel features of the invention will become more apparent from the following detailed description when taken in conjunction with the accompanying drawings.

DETAILED DESCRIPTION OF THE PREFERRED EMBODIMENT

Figure 1:
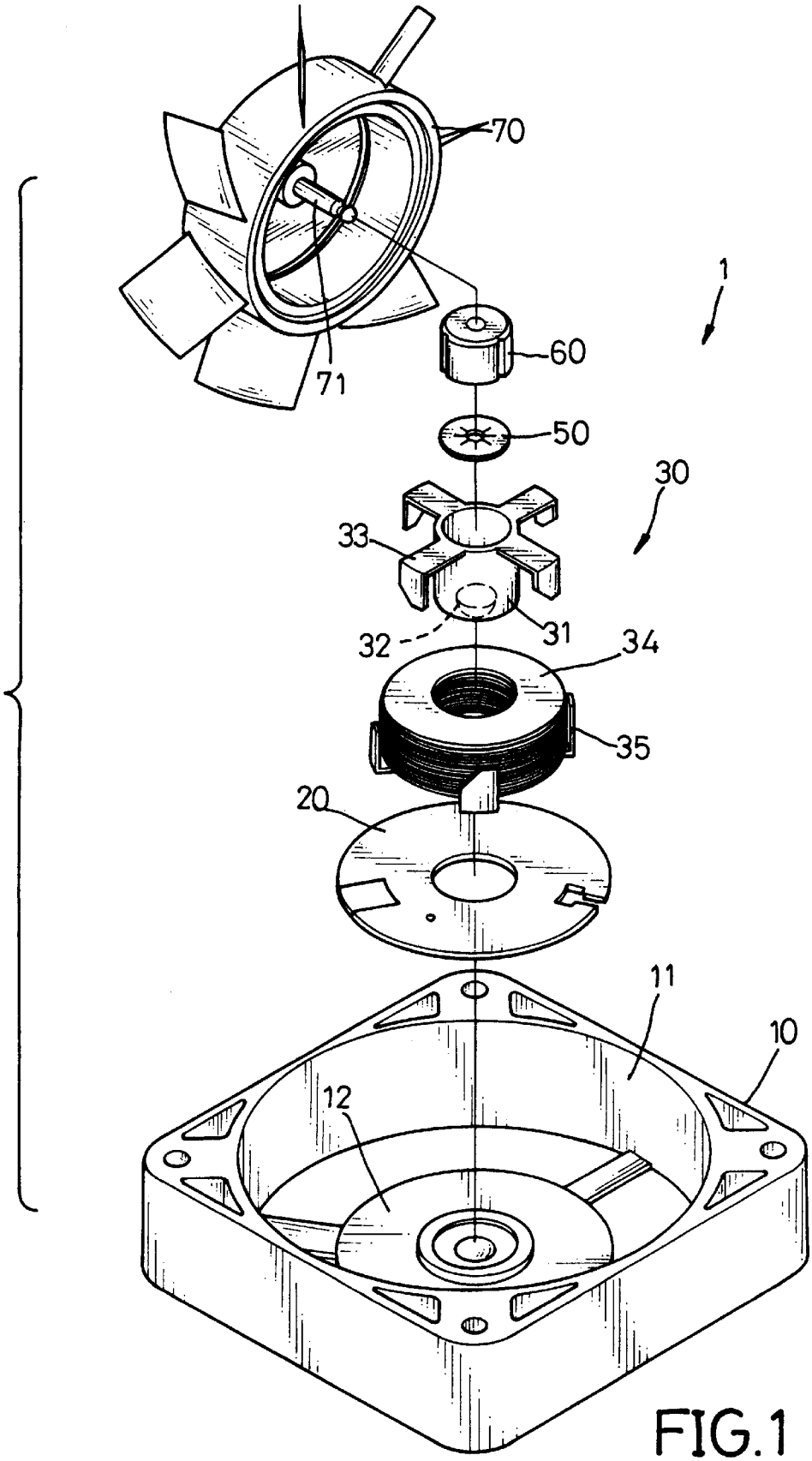
FIG. 1 is an exploded perspective view of a cooling fan in accordance with the invention.

Referring to FIG. 1, a cooling fan (1) in accordance with the present invention comprises a housing (10) with a circular recess (11) defined therein and a seat (12) formed at a bottom face thereof. A circuit board (20), a stator assembly (30), a collar (50), a self-lubricating bearing (60) and a rotor (70) are in turn coaxially mounted in the recess (11) of the housing (10).

Figure 2:
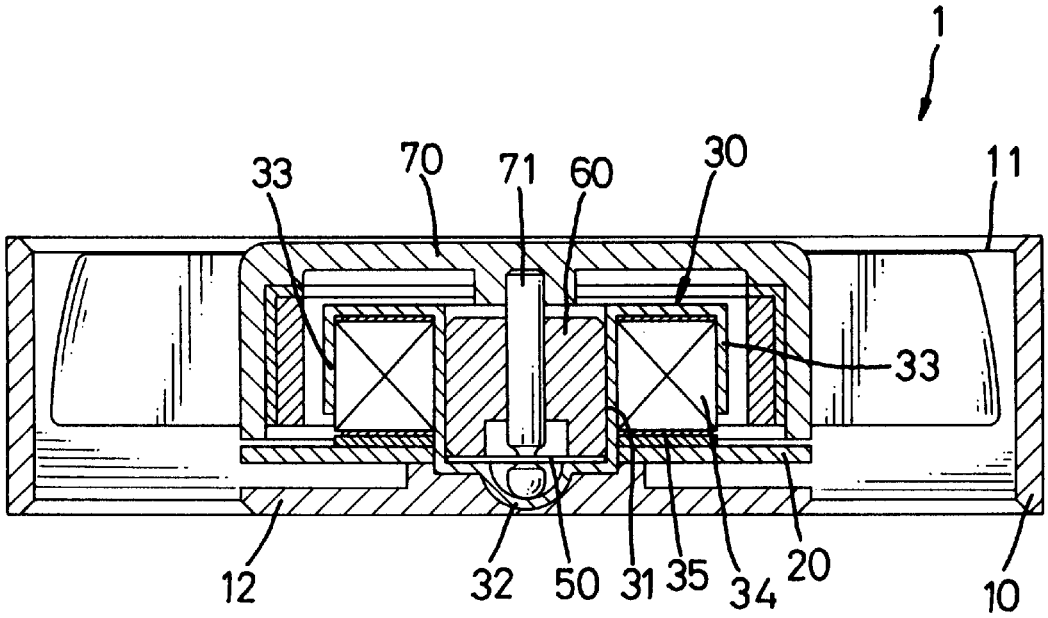
FIG. 2 is a cross-sectional view showing the cooling fan of FIG. 1.
Figure 3:
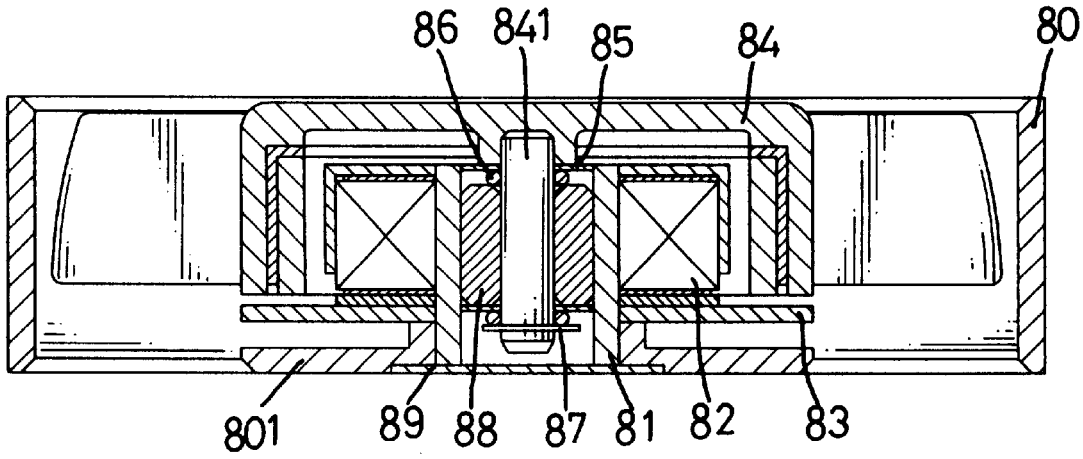
FIG. 3 PRIOR ART
FIG. 3 is a cross-sectional view of a conventional cooling fan.

Referring to FIG. 2, the circuit board (20) is secured on the seat (12) of the housing (10). The stator assembly (30) has a coil (34) with an opening (not numbered) and is fixedly mounted on the circuit board (20) by a bracket (35) provided beneath the coil (34). A sleeve (31), of which a first end is enclosed, is received in the opening of the coil (34). The sleeve (31) has an external dome (32) formed at the first end thereof. A fastener (33) composed of a plurality of wings (not numbered) is integrally formed with a second end of the sleeve (31), wherein the wings each comprise a laterally extended arm (not numbered) and a finger (not numbered) perpendicularly extended from a distal edge of the arm and toward the first end of the sleeve (31). The arms of the wings are engaged with a top face of the coil (34) and the fingers of the wings are engaged with an outer circumference of the coil (34) to fasten the sleeve (31) on the coil (34).

The collar (50) defines an aperture (not numbered) and is provided on a bottom face of the sleeve (31). The self-lubricating bearing (60) is received and secured in the sleeve (31) and placed upon the collar (50).

The rotor (70) has a plurality of magnets (not shown) mounted along an inner circumference thereof, and a core (71) formed at the center thereof. The core (71) has a head formed at a distal end thereof. The core (71) is secured in the self-lubricating bearing (60) and the head of the core (71) is inserted through the collar (50) and received in the dome (32).

From the above description, it is noted that the invention has the following advantages:

1. In assembly, the self-lubricating bearing (60) can be first assembled on the core (71) of the rotor (70), and afterward received in the sleeve (31). The collar (50) prearranged in the sleeve (31) can be directly engaged on the core (71) without using any special tools.
2. Because the sleeve (31) is enclosed at the second end thereof, the lubrication of the bearing (60) will not leak out and so the bearing (60) will not run dry.
3. Because the sleeve (31) is enclosed at the first end and oil-seals are eliminated, the friction between the core (71) and the sleeve (31), or the core (71) and the self-lubricating bearing (60) is very small, then the noise cause by the friction is negligible.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cooling fan comprising:

a housing (10) having a recess (11) defined therein and a seat (12) forming a bottom face thereof;

a circuit board (20) secured on said seat (12) of said housing (10);

a coil (34) having an opening defined therethrough;

a bracket (35) provided beneath said coil (34) to fix said coil (34) on said circuit board (20);

a sleeve (31) with an enclosed first end and received in said opening of said coil (34), and having a fastener (33) formed at a second end thereof which is engaged with an outer side of said coil (34);

a collar (50) provided at a bottom face of said sleeve (31);

a self-lubricating bearing (60) provided in said sleeve (31) and on said collar (50); and a rotor (70) having a core (71) received in said bearing (60) and inserted through said collar (50), whereby the cooling fan can be assembled easily and produces negligible noise during operation.

2. The cooling fan as claimed in claim 1, wherein the sleeve (31) further has an external dome (32) formed at said first end thereof, and a head of said core (71) is received in said dome (32).

3. The cooling fan as claimed in claim 1, wherein the fastener (33) is composed of a plurality of wings each having a laterally extended arm and a finger perpendicularly formed at a distal end of said arm and facing said first end of said sleeve.

* * * * *